US006149157A

United States Patent [19]

Suan

[11] Patent Number: 6,149,157

[45] Date of Patent: Nov. 21, 2000

[54] HAND PICKED POKER GAME AND METHOD THEREFOR

[75] Inventor: Marcus M. Suan, Las Vegas, Nev.

[73] Assignee: Coast Hotels & Casinos, Inc., Las Vegas, Nev.

[21] Appl. No.: 09/315,191

[22] Filed: May 19, 1999

[51] Int. Cl.[7] ..... A63F 1/00

[52] U.S. Cl. ..... 273/292; 273/139; 273/269; 273/303; 463/13

[58] Field of Search ..... 273/139, 240, 273/292, 269, 274, 303; 463/13

[56] References Cited

U.S. PATENT DOCUMENTS

| | | |
|---|---|---|
| 816,553 | 4/1906 | Becker . |
| 1,527,929 | 2/1925 | Simons . |
| 2,609,204 | 9/1952 | Wixson . |
| 3,069,168 | 12/1962 | Feldman . |
| 4,560,161 | 12/1985 | Hamano . |
| 4,560,171 | 12/1985 | Anthony . |
| 5,019,973 | 5/1991 | Wilcox . |
| 5,029,871 | 7/1991 | Wilson . |
| 5,092,598 | 3/1992 | Kamille . |
| 5,100,139 | 3/1992 | Di Bella . |
| 5,377,992 | 1/1995 | Audet . |
| 5,685,541 | 11/1997 | Lovell . |
| 5,823,873 | 10/1998 | Moody . |
| 5,975,529 | 11/1999 | Dekeller . |

*Primary Examiner*—Benjamin H. Layno
*Assistant Examiner*—Vishu Mendiratta
*Attorney, Agent, or Firm*—Jeffrey Weiss; Jeffrey D. Moy; Weiss & Moy, P.C.

[57] ABSTRACT

A method of playing a video poker game which allows the player to pick the cards to form his or her poker hand. All the playing cards are placed lying face down. The player picks and turns over a predetermined number (i.e. five) of the playing cards to form an initial poker hand. The player then determines which of the selected cards to hold. If one or more of the selected playing cards are discarded, the player selects and turns over replacement playing card(s) from the remainder of the playing cards which are lying face down.

4 Claims, 2 Drawing Sheets

HAND PICKED POKER GAME AND METHOD THEREFOR

BACKGROUND OF THE INVENTION

1. Field of the Invention

This invention relates to games for the gaming industry and methods therefor and, more specifically, to a new poker game and method therefor which allows each player to select his or her own poker hand.

2. Description of the Prior Art

Various forms of games of chance are played throughout the world (i.e., poker, blackjack, etc.). The problem with each of these different games is that the participant has no freedom as to the cards which are dealt to them. Either a computer or a dealer will select and deal a card or cards to each participant. Participants are always complaining that the dealer or computer dealt them a bad hand or did not give them the card or cards that he or she needed.

With specific regard to playing poker which has become a challenging game to poker players, there are essentially two general types of poker games. One type is known as "live" poker where a person plays against other players and there is one dealer (either a casino dealer or one of the poker players) who distributes the cards in a clockwise manner from one player to the other players. The other type of the two types of poker games is "video" poker where each player will sit in front of a video screen and press certain buttons to receive cards, to select which cards to hold (if any are desired to be held) and to draw new cards to replace the cards not selected to be hold of the original five cards initially received for each hand of poker.

As stated earlier, the player (in either of these two types of poker games) can't select the cards to be given to the player. For the video poker game, the cards are selected internally by computer from a random number generator and, therefore, the video poker player will only receive those cards selected each time by the computer (microprocessor) in the video poker game.

Therefore, a need existed to provide a new poker game and method therefor which would provide a poker player with a positive choice in the selection of the cards to be received by the poker player. The new poker game and method will allow individual players to select their own starting hand by selecting a predetermined number of initial playing cards from a set of 52 playing cards lying face down. The now poker game and method will further allow the individual players to discard and select replacement cards from the remaining playing cards that are lying face down. Thus, in the example of a video poker game, each individual player can select their own initial five playing cards and, after these five playing cards are disclosed to the player, then have the option of selecting one or more replacement cards for these five initial playing cards.

SUMMARY OF THE INVENTION

In accordance with one embodiment of the present invention, it is an object of the present invention to provide a now poker game and method therefor.

It is another object of the present invention to provide a new poker game and method that will allow individual players to select their own starting hand by selecting a predetermined number of playing cards from a set of playing cards lying face down.

It is still another object of the present invention to provide a new poker game and method that will further allow the individual players to discard and select replacement cards from the remaining playing cards that are lying face down.

It is a still further object of the present invention to provide a new video poker game and method therefor which will allow individual players to select their own starting hand by selecting a predetermined number of playing cards from a set of playing cards lying down and then discard and select replacement cards from the remaining playing cards that are lying face down.

BRIEF DESCRIPTION OF THE PREFERRED EMBODIMENTS

In accordance with one embodiment of the present invention, a method of playing a poker game is disclosed. The method comprises the steps of: providing all the playing cards lying face down; selecting and turning over a predetermined number of the playing cards from the playing cards lying face down by a player to form a poker hand; optionally deciding one of keeping all of the selected playing cards or discarding at least one of the selected playing cards; and selecting and turning over playing cards from a remainder of the playing cards lying face down by the player to replace the at least one of the playing cards which was discarded.

In accordance with another embodiment of the present invention, an electronic hand picked video poker game is disclosed. An electronic hand picked video poker game is disclosed which comprises, in combination: video display means for displaying all playing cards lying face down; means for selecting and turning over a predetermined number of selected playing cards from the playing cards lying face down by a player to form a poker hand; means for optionally deciding one of keeping all of the selected playing cards or discarding at least one of the selected playing cards; and means for selecting playing cards from a remainder of the playing cards lying face down by the player to replace the at least one of the selected playing cards which was discarded if the player discarded at least one of the selected playing cards.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENT

Figure 1:
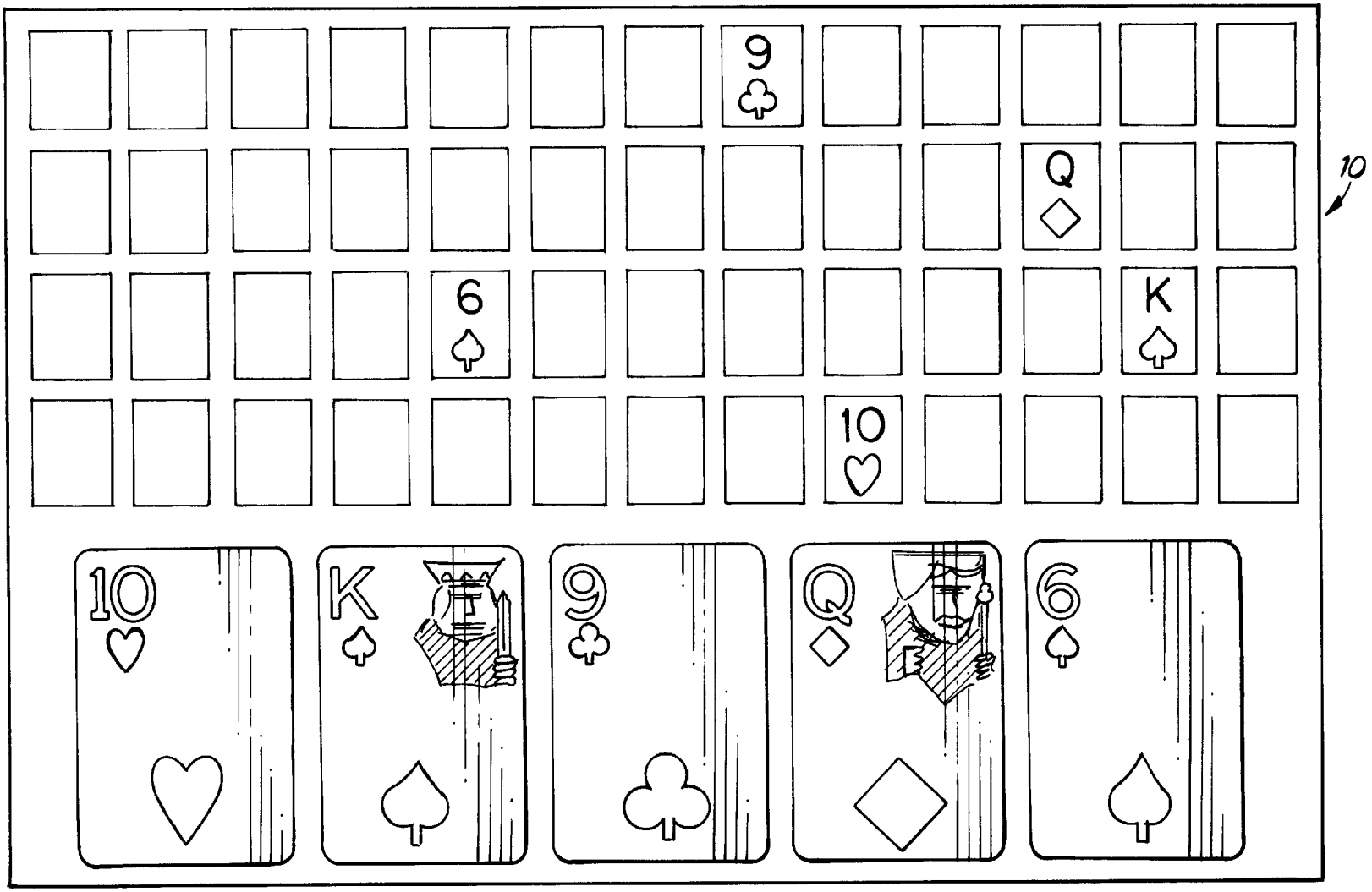
FIG. 1 shows one example of a video screen of the hand picked video poker game of this invention.

Referring to FIG. 1, the method of playing hand picked poker in accordance with this invention will be described with reference to a video poker game. A deck of 52 playing cards is shown on a video poker apparatus with all of the playing cards facing down in a random order. In the preferred embodiment of the present invention a single set of 52 regulation playing cards is used. However, this should not be seen as to limit the scope of the patent as more than one deck of playing cards may be used, if desired.

Once the playing cards on the video poker apparatus 10 are all displayed face down, in a random order, a video poker player will select a predetermined number of the playing cards based on the type of poker game he or she is playing. If the player is playing Five Card Draw Poker, the player will select five playing cards. These five playing cards are then turned over revealing the player's starting poker hand. The player will then select which of the selected playing cards he or she wishes to hold. Any card that the player does not hold will be discarded. The player will then be able to select replacement cards, from the remainder of the playing cards 10 that are lying face down, for any of the selected playing cards which were discarded. After the player selects his or her replacement cards, the replacement cards are exposed revealing the player's final poker hand. The final poker hand is evaluated to determined whether the player has won. The higher the final hand, the more money or credits the player will win. The final hand is evaluated based on standard poker hands (i.e., 1. royal flush, 2. straight flush, 3. four of a kind, 4. full house, 5. flush, 6 straight, 7. three of a kind, 8. two pairs, and 9. one pair). Preferably, the player must have a hand of one pair of jacks or higher in order to win any money or credits. After the final hand is evaluated, the remainder of the playing cards that are lying face down will be turned over and exposed to thereby show the player the honesty of the poker game and the actual location of unselected cards that would have given the poker player a better hand. The hand picked poker game may be played on a gaming table. However, preferably, the hand picked poker game will be played as a video (hand picked) poker game.

Figure 2:
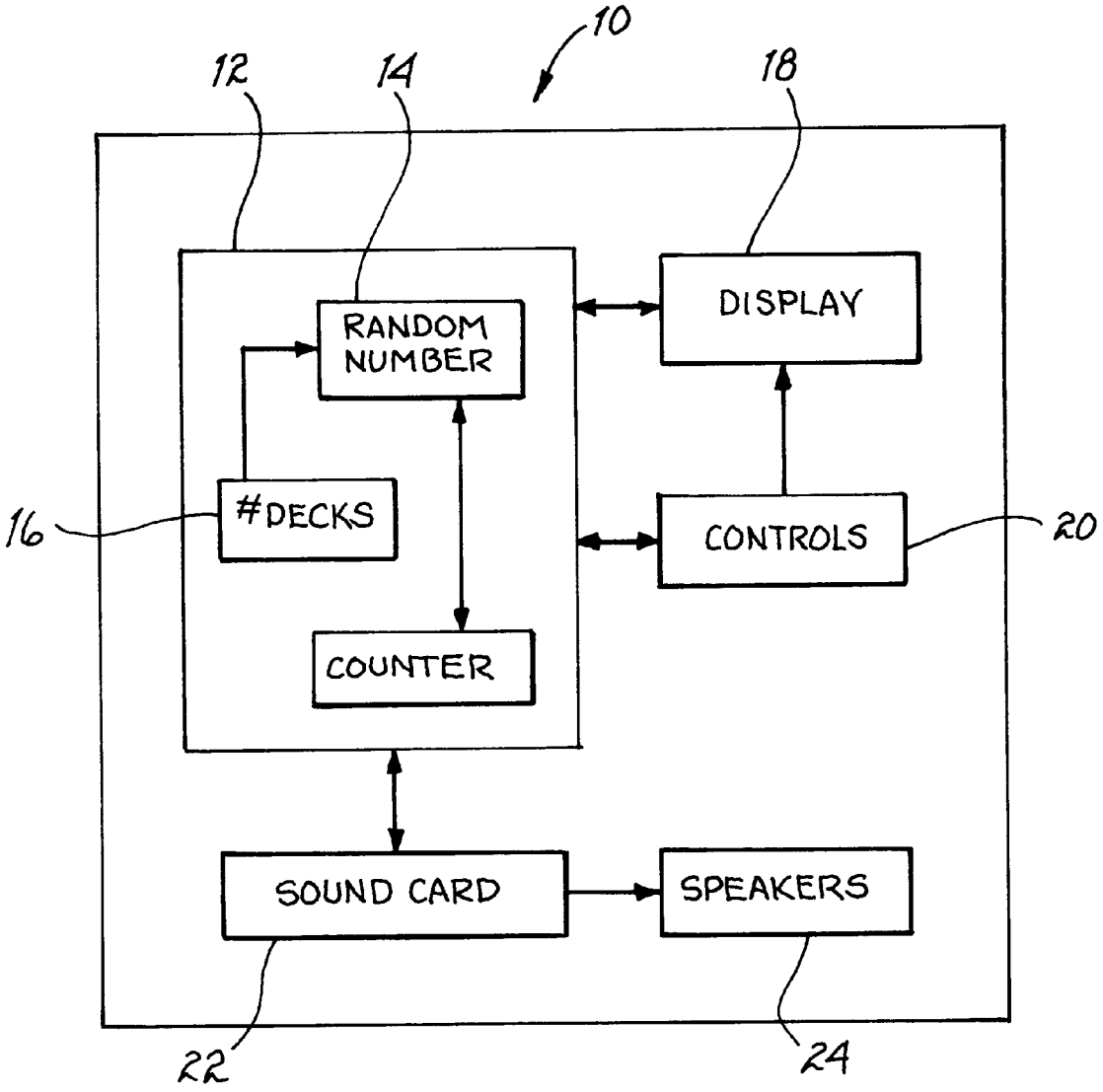
FIG. 2 is a simplified functional block diagram of the electronic hand picked video poker game of this invention.

Referring to FIG. 2, a simplified functional block diagram for use in the video hand picked poker apparatus or game 10 (hereinafter video game 10) of FIG. 1 is shown. The video game 10 has a processor 12 for controlling the operation of the video game 10. The processor 12 has a random number generator 14 which is coupled to a card deck input 16. The card deck input 16 is used to tell the random number generator 14 how many standardized playing card decks are being used. As stated above, in the preferred embodiment of the present invention, a single deck of 52 playing cards is used.

The processor 12, via a graphics interface, located within the processor 12 will display all of the 52 playing cards which will be shown lying face down on video display 18 coupled to the processor 12. The video display 18 is, for example, the display shown in FIG. 1. The player will then select a predetermined number of the playing cards based on the type of poker game he or she is playing. If the player is playing Five Card Draw Poker, the player will select five playing cards. The player selects the desired playing cards using one of the following methods. Controls 20 (as described below) coupled to the processor 12 and the display 18 permit the player to operate the video game 10. For example, the controls 20 can comprise a control pad (not shown) which is designed to allow the player to move an icon around on the display 18. The player may then indicate which cards he or she wishes to select. The control pad will function in a similar manner to a joystick or a mouse input to a computer. The player may also let the processor 12 pick the cards by pushing a autodraw button (not shown) on a control panel (not shown) coupled to and part of the controls 20. In the preferred embodiment of the present invention, the video display 18 (which is the display shown in FIG. 1) of the video game 10 of FIG. 1 is a video touch screen display. The player may thus select the desired playing cards lying face down (see FIG. 1) by touching the desired playing card on the touch screen display.

After the player has selected a desired playing card, the selected playing card is turned over or displayed face up revealing one of the playing cards for the player's starting poker hand. The selected playing card will also be more prominently displayed at the bottom of the video screen as shown in FIG. 1. This process will continue until the player has selected the desired number of playing cards to form his or her starting hand.

Once the player has selected his or her starting poker hand, the player must decide which of the selected playing cards he or she wishes to hold. Any card that the player does not hold will be discarded. The player may select which card(s) he or she holds using one of the following methods. The controls 20 will preferably comprise control buttons (not shown) located on the video game 10. For example, a control button is located directly below each prominently displayed selected playing card. The player may then press the button below the initially selected playing card the player wishes to keep. As stated above, in the preferred embodiment of the present invention, the video display is a video touch screen display. Thus, alternatively, the player may hold the initially selected playing card by touching the playing card on the touch screen display.

The player will next choose playing cards from the remaining playing cards lying face down to replace the playing cards he or she did not hold. The player will select these replacement cards (or card if only one playing card is needed such as when a player decides to hold four of the five initially selected playing cards) from the remaining playing cards lying face down. In some instances no replacement cards may be required if the initial hand is a winning hand. The player may select replacement playing cards by either moving an icon to a desired card using a mouse, by pushing an autodraw button (one of the control buttons), or by touching the desired (face down) playing card on the video touch screen. After the player has selected each desired replacement card, the replacement playing card is turned over and displayed. Each replacement playing card will also be prominently displayed at the bottom of the video screen as shown in FIG. 1 in place of the previously displayed initial playing card that was selected to be replaced. This process will continue until the player has selected the desired number of replacement playing cards to form his or her final poker hand. The final poker hand is then evaluated to see if the player won and the amount the player won if the final hand of the player is a winning hand. The remaining cards that are lying face down are then exposed to show the player the true location of the unselected playing cards.

The video game 10 may have several other features. The video game 10 may have a sound card 22 coupled to the processor 12 and speakers 24 coupled to the sound card 20 as shown in FIG. 2. The sound card 22 and speakers 24 will allow the video game 10 to have numerous different kinds of desired sound effects to make the video game 10 more entertaining. The video game 10 may also be coupled to one or more other video games (not shown). This would allow the video game 10 to be networked with a large host computer (not shown) to form a progressive type of jackpot if a certain highly ranked or desired poker hand is hand picked.

Game Operation

Players start the poker game by depositing money into a money receptacle (not shown). The processor 12 will monitor the input of the money receptacle and display the number of credits on the video screen of the video game 10. The player will then ante up. The player will ante up by pressing, for example, one of two buttons on the control panel. The control panel will have, for example, a bet one button or a maximum bet button. By depressing the bet one button multiple times, this will increase the ante. When the player antes up, the processor 12 will simultaneously deduct credits from the player and will show the current remaining credits on the video screen.

The player then selects his or her first hand in one of the manners described above. After the player selects his or her first hand (the five initial cards) another round of betting may occur or, if desired, no further betting may occur after the first five playing cards are selected.

The player then chooses his or her hold cards by one of touching them on the touch video screen or using the corresponding hold button. Replacement playing cards are then selected if desired. After the last replacement card is selected, or after all the cards are finally held, the remainder of the playing cards are exposed and the poker hand is evaluated.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of playing poker comprising the steps of:

providing all playing cards lying face down;

selecting and turning over a predetermined number of selected playing cards from said playing cards lying face down by a player to form a poker hand;

optionally deciding one of keeping all of said selected playing cards or discarding at least one of said selected playing cards;

selecting playing cards from a remainder of said playing cards lying face down by said player to replace said at least one of said selected playing cards which was discarded if said player discarded at least one of said selected playing cards; and turning over all of said playing cards lying face down which were not selected by said player after said selected playing cards are finally selected.

2. A method of playing poker comprising the steps of:

placing a beginning wager;

providing all playing cards lying face down in a plurality of rows and columns;

selecting and turning over a predetermined number of selected playing cards from said playing cards lying face down by a player to form a poker hand;

placing a second wager;

optionally deciding one of keeping all of said selected playing cards or discarding at least one of said selected playing cards;

selecting playing cards from a remainder of said playing cards lying face down by said player to replace said at least one of said selected playing cards which was discarded if said player discarded at least one of said selected playing cards; and turning over all of said playing cards lying face down which were not selected by said player after said selected playing cards are finally selected.

3. An electronic hand picked video poker game comprising, in combination:

video display means for displaying all playing cards lying face down;

means for selecting and turning over a predetermined number of selected playing cards from said playing cards lying face down by a player to form a poker hand;

means for optionally deciding one of keeping all of said selected playing cards or discarding at least one of said selected playing cards;

means for selecting and turning over playing cards from a remainder of said playing cards lying face down by said player to replace said at least one of said selected playing cards which was discarded if said player discarded at least one of said selected playing cards; and means for turning over all of said playing cards lying face down which were not selected by said player after said selected playing cards are finally selected.

4. The electronic hand picked video poker game of claim 3 wherein the video display means is a touch screen display and the means for selecting playing cards and replacement playing cards are accomplished by touching each selected card and each replacement card on said touch screen display.

* * * * *